US010793245B1

(12) United States Patent
Trotter

(10) Patent No.: US 10,793,245 B1
(45) Date of Patent: Oct. 6, 2020

(54) BOAT SAFETY SYSTEM

(71) Applicant: Daniel Scott Trotter, Gilbert, SC (US)

(72) Inventor: Daniel Scott Trotter, Gilbert, SC (US)

( * ) Notice: Subject to any disclaimer, the term of this patent is extended or adjusted under 35 U.S.C. 154(b) by 0 days.

(21) Appl. No.: 16/440,432

(22) Filed: Jun. 13, 2019

(51) Int. Cl.

| | |
|---|---|
| ***B63H 21/21*** | (2006.01) |
| ***B63H 21/22*** | (2006.01) |
| ***G08C 17/02*** | (2006.01) |
| ***G08B 21/08*** | (2006.01) |
| ***G08B 7/06*** | (2006.01) |

(52) U.S. Cl.
CPC ..... *B63H 21/21* (2013.01); *B63H 21/22* (2013.01); *G08B 7/06* (2013.01); *G08B 21/08* (2013.01); *G08C 17/02* (2013.01); *B63H 2021/216* (2013.01)

(58) Field of Classification Search
CPC .. B63H 21/21; B63H 21/22; B63H 2021/216; G08C 17/02; G08B 7/06; G08B 21/08
USPC ..... 340/984
See application file for complete search history.

(56) References Cited

U.S. PATENT DOCUMENTS

| | | | | |
|---|---|---|---|---|
| 3,774,720 | A | 11/1973 | Hovey | |
| 4,539,452 | A | 9/1985 | Drexler et al. | |
| 6,276,974 | B1 | 8/2001 | Bouge et al. | |
| 6,354,892 | B1 | 3/2002 | Staerzl | |
| 6,450,845 | B1 * | 9/2002 | Snyder | B60N 2/002 280/735 |
| 6,676,460 | B1 * | 1/2004 | Motsenbocker | B63B 43/18 440/1 |
| 7,355,518 | B1 * | 4/2008 | Staerzl | B60N 2/002 340/573.1 |
| 8,267,731 | B2 * | 9/2012 | Arvidsson | B63B 43/18 440/56 |
| 8,542,092 | B2 | 9/2013 | Lumley et al. | |
| 10,062,529 | B2 | 8/2018 | Barker | |
| 2004/0156327 | A1 * | 8/2004 | Yankielun | G08C 17/02 370/310 |
| 2007/0256620 | A1 * | 11/2007 | Viggiano | B63C 9/0005 114/39.16 |
| 2015/0019045 | A1 * | 1/2015 | Holliday | G06K 19/07762 701/2 |
| 2020/0031448 | A1 * | 1/2020 | Gonring | F02N 11/0803 |

* cited by examiner

*Primary Examiner* — Hirdepal Singh
(74) *Attorney, Agent, or Firm* — Southeast IP Group, LLC.; Thomas L. Moses

(57) ABSTRACT

A safety system for a boat, watercraft or other vehicle includes a kill switch connected to the motor for preventing the motor from running under dangerous circumstances. The system includes a fob that wirelessly communicates with the kill switch, so that the motor only runs when the fob is within a predetermined distance from the captain's console. Other sensors communicate with the kill switch, either hard-wired together or wirelessly, upon detection of dangerous situations, including proximity sensors to detect if a swimmer is near the propeller or if the captain is not in position at the helm, gate sensors to detect when gates on the boat are in an open position, and ladder sensors to detect when a ladder is in a down position. The system may also include an alarm emitting a visual or audible warning to the boat captain based on input from the sensors.

18 Claims, 6 Drawing Sheets

BOAT SAFETY SYSTEM

BACKGROUND OF THE INVENTION

The present invention relates to systems for reducing or eliminating injury or damage caused by spinning boat propellers coming into contact with people, animals or other objects that are in close proximity to a boat. More specifically, the present invention is a system that may include a variety of sensors and switches for detecting when a person or object is in close proximity to a boat motor or propeller, and preventing the motor from starting or running under such circumstances.

Every year, a significant number of people are injured while boating because the spinning propeller comes into contact with a person in the water behind the boat. For many types of boating activities, including skiing, tubing, or swimming, it is very common for people to be in the water behind the boat, for various reasons. Most boats have ladders in the stern area for swimmers to climb into and out of the water, which dictates that people will often be in close proximity to the propeller. If a boat captain puts the boat motor into gear while people or objects are in the water behind the boat, then the likelihood of an accident increases significantly. Therefore, it would be advantageous to provide a smarter system that detects certain circumstances when the propeller should not be engaged, such as when people are in the water nearby or the ladder is extended downwardly into the water, and prevents the motor from starting (or rotating the propeller) under these types of circumstances. Additionally, if there are submerged hazards, such as stumps, rocks, or other debris in close proximity to the boat motor, it would be advantageous to have a system that detects these hazards and prevents the propeller from spinning, in order to prevent damage to the propeller, the motor, or the boat itself.

Additionally, most boats manufactured today include a 'kill-switch' that includes a lanyard attached to a switch adjacent the captain's chair or console. The boat captain typically attaches the lanyard around his wrist at one end, and the other end of the lanyard is attached to the kill switch on the boat. The boat will run as long as the lanyard is attached to the kill switch, but if the lanyard becomes disconnected from the kill switch, then the motor shuts off automatically and immediately. Thus, if a boat captain falls overboard, for instance, while wearing the lanyard attached to the kill switch, then the lanyard becomes disconnected from the kill switch, and the motor stops, thereby preventing the boat from continuing onward without its captain. These types of lanyard kill switches are used on many types of watercraft, including personal watercraft, small motors on jon boats, ski boats, fishing boats, and the like.

Various efforts have been made in the past to enhance boater safety and wireless proximity systems and sensors. The following documents are hereby incorporated by reference herein, in their entireties.

U.S. Pat. No. 3,774,720 Power-Operated Retractable Ladder for Pleasure Boats

A boat ladder for pleasure boats to enable a user to easily get into or out of a boat when in the water and also get into and out of the boat when loaded on a transporting trailer, including a movable section and a stationary section supported from the boat hull, together with an interconnection with the movable section to move it from an extended position to a retracted position.

U.S. Pat. No. 6,276,974 Switch System for Preventing Marine Propeller Injuries

A system to prevent injuries due to marine propellers striking swimmers and other persons in the water next to a boat utilizing a switch. The switch is normally in a closed position and is only opened when a movable element such as a ladder, gate, and the like on the boat travels to an unlatched position. Such movement interrupts the ignition circuit of the boat motor. An override device is also employed to allow normal operation of the marine engine and requires both mechanical and electrical interconnection or matting of connector elements.

U.S. Pat. No. 6,354,892 Safety Device for a Marine Vessel Floating Cooler

A safety for a marine vessel provides an infrared sensor with a tube having a central cavity in order to define a viewing angle which is more narrow than the inherent viewing angle of the infrared sensor. The central cavity of the tube also defines a line of sight that can be directed toward a particular region near a marine vessel that is to be monitored for the presence of a heat generating object, such as a human being. An alarm circuit is responsive to signals from the infrared sensor and deactivates the marine propulsion system when a heat generating object is near the marine propulsion system. The length and diameter of the tube are selected to provide a desired viewing angle for the infrared sensor. An audible alarm output is provided if an attempt is made to manipulate a joystick that controls the marine propulsion system when a heat generating object is sensed by the infrared sensor.

U.S. Pat. No. 6,676,460 Electronic Propeller Guard

Electronic methods, devices and kits electronically protect swimmers, animals and other objects in water from propeller strikes, and alleviate propeller damage. Desirable embodiments include continuous ultrasonic sensing and detection by separate sensors to minimize reaction time for stopping internal combustion engine and electric motor driven propellers. Electric boats having direct drive to propellers are particularly amenable for electronic propeller protection. A variety of sensors may be used, including tactile, ultrasonic, galvanometric and infrared sensors. Optionally, the devices and systems can improve performance, safety and economy of boat rental operations by discouraging, limiting and even reporting propeller strikes to a boat custodian, who may be at a different location when the boat is used.

U.S. Pat. No. 8,542,092 Keyless-go Ignition Switch with Fault Backup

A vehicle ignition system includes a fob for transmitting an identification code. The fob includes a low frequency transceiver circuit and low frequency antenna. An ignition module is provided including, a housing, switch contacts and a push button slidably mounted in the housing and arranged so that pushing of said button closes said switch contacts. A LF coil is provided and is axially stationary within the housing and is located inside of the push button. An ignition module circuit provides power to the fob and establishes low frequency communications with the fob via the LF coil. An immobilizer circuit is operatively coupled to the ignition module for permitting or preventing actuation of the ignition system in response to the low frequency communications with the fob and the ignition module.

U.S. Pat. No. 10,062,529 Motor Kill Switch Arrangement

The present invention relates to motor safety devices as used in increasing numbers for the killing of engines or disengaging propulsion units from motors, when there are no operators to maintain control of an apparatus or vehicle such as jet-ski, boat, go-kart and the like or personnel to oversee use of a 5otorized tool or the like. Motor boat operators on a boat have been known to fall overboard without being detected by the operator of the boat. Such runaway boats have been known to seriously injure the operator of the boat in the water since a runaway boat tends to circle back to the place where the operator has fallen overboard. The present invention is also applicable to other types of equipment such as 5otorized gymnasium equipment, hand operated power tools, such as agricultural and arboriculturist equipment and wood working tools.

U.S. Pat. No. 4,539,452 Safety Stop Switch Assembly

A safety stop switch assembly (10) for controlling a device such as an outboard motor includes a toggle switch having a switch arm (12). A clip (16) is held in place around the switch arm (12) by a spring arm (21). The clip (16) can be attached to the operator by a lanyard (17). When the operator is sufficiently removed from the device, the lanyard (17) will pull the clip (16) away from the switcharm (12) and turn the switch off. The switch arm (12) can be used to control the outboard motor with or without the use of the clip (16).

SUMMARY OF THE INVENTION

In one embodiment, the present boat safety system includes a kill switch that is in wireless communication with a fob carried by a user (boat captain). In this embodiment, the fob must be in close proximity to the captain's chair or console, similarly to a keyless fob that starts an automobile, wherein the fob must be inside or very close to the vehicle. The fob includes a radio transmitter or other wireless transmission device that communicates with the kill switch on the boat, so that the motor will run only when the fob is in close proximity to the console. Otherwise, the motor will not run.

Other sensors may be incorporated into the system, as well. For instance, a sensor or switch may be used to detect whether a ladder is in the up position, or the down position, and may communicate with the kill switch so that the motor will not start or run while the ladder is in the down position. Similarly, such a sensor or switch can detect whether hatches, doors, gates, or the like are in the open position for the same purpose. Proximity sensors may be deployed around the stern area of the boat to detect if swimmers or other objects are in the water near the propeller, and may automatically prevent the motor from starting (or, alternatively, may prevent the propeller from rotating or engaging into gear while the motor idles). In some embodiments, the proximity sensors, gate sensors and ladder sensors may be hard wired and connected to the kill switch, or alternatively, connected directly to the electronics within the motor. In other embodiments, these sensors may be battery operated, and may communicate wirelessly with the kill switch on the boat.

In another embodiment, a console proximity sensor may be used to detect the presence of a vehicle operator in the proper position to operate the vehicle. On a boat, the proximity sensor senses when a captain is at the helm, and allows the motor to run only so long as the proximity sensor senses that the captain is in proper position to operate the boat. This embodiment may also be used on other vehicles, including all-terrain vehicles, personal watercraft, and the like. If the driver falls off the vehicle, then the proximity sensor detects that the operator is no longer in the proper position to operate the vehicle, and the kill switch shuts down the motor.

BRIEF DESCRIPTION OF THE DRAWINGS

These and other features, aspects, and advantages of the present invention will become better understood with regard to the following description, appended claims, and accompanying drawings where:

FIG. 1 is a perspective view of one embodiment of a kill switch used on watercraft for shutting down a boat motor and a wearable fob, wherein the kill switch in this embodiment includes a wireless receiver for receiving input from the fob and various sensors, including proximity sensors, contact sensors, and the like;

DETAILED DESCRIPTION OF THE INVENTION

Figure 1:
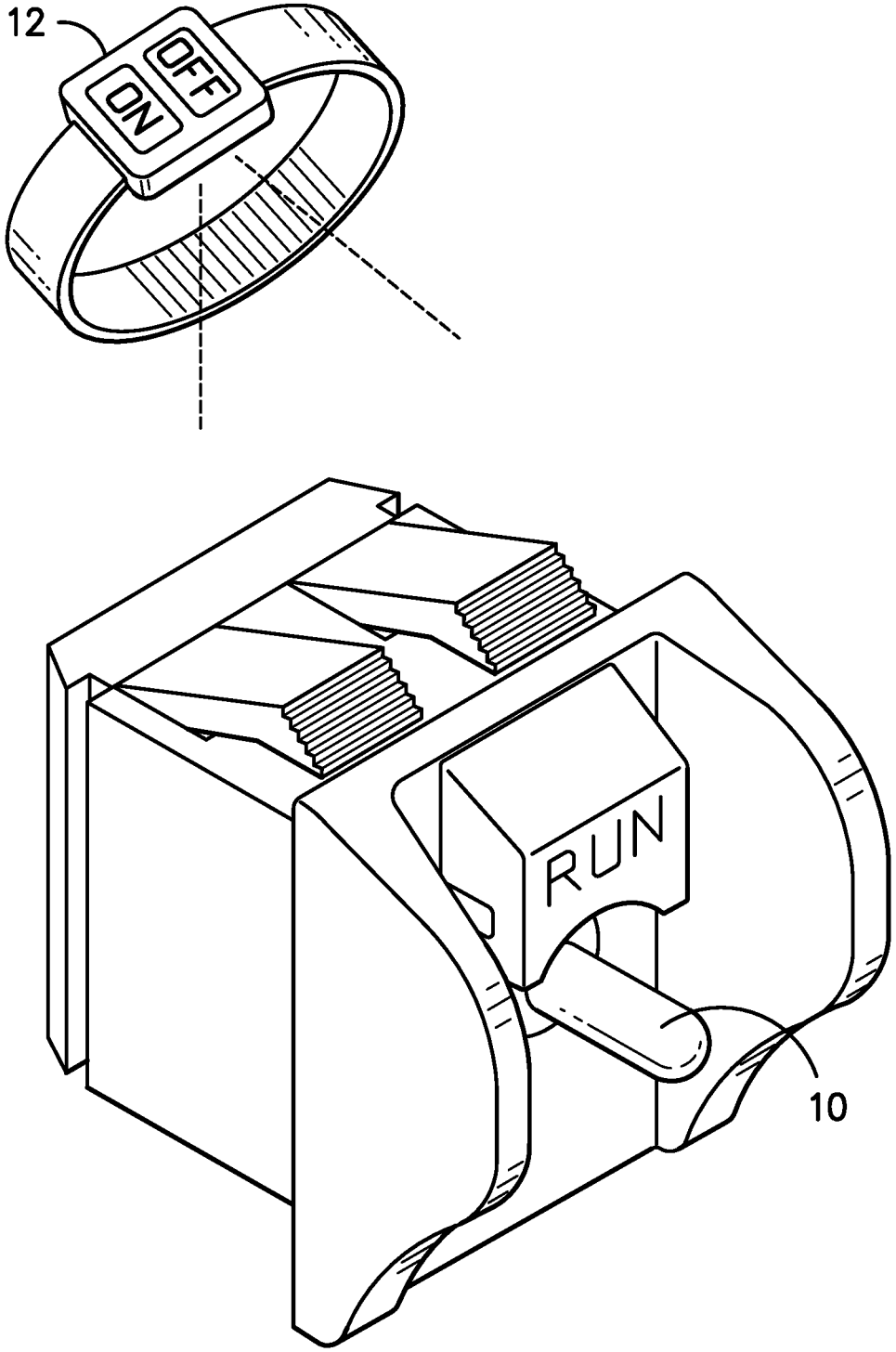

The present invention, in a first embodiment, is a boat safety system that includes a kill switch 10 that is operatively connected to a boat 14 or watercraft motor in the traditional manner, and a fob 12 that communicates with the kill switch 10 wirelessly, so that the fob 12 must be in close proximity to the captain's chair 16 or console 18 in order to start the boat motor 20. This wireless fob 12 may work in a similar manner to that disclosed in U.S. Pat. No. 8,542,092, which is incorporated herein by reference. Preferably, the proximity required for the fob 12 to wirelessly connect to the kill switch 10 is adjustable to a user's preference, so that it may extend to the bow 22 and stern 24 of the boat 14, if desired. Otherwise, the fob 12 should be within about 3 feet from the console 18 in order for the kill switch 10 to allow the motor 20 to start and run. It is contemplated that the fob 12 may take various forms, including as a wearable device, as shown in FIG. 1. It may be in the form of a bracelet, necklace or wristband worn by the captain, or it may include a clip or carabiner for attachment to the captain's clothing or bathing suit. Preferably, the fob 12 is waterproof, so that submersion in water does not cause damage thereto. Further, the fob 12 may be used to start the ignition of the motor 20 in some embodiments, if desired, or in another embodiment, a traditional key or start button may be used to start the motor 20 while the fob 12 is in close proximity to the captain's console 18, the kill switch 10, or in some cases, the motor 20.

The kill switch 10 preferably works like traditional kill switches on boats, with the exception that it includes means for wirelessly communicating with the fob 12 and the various sensors that may be used around the boat 14. In one embodiment, the kill switch 10 includes a receiver and transmitter that wirelessly communicates with the fob 12, as described above, and also receives signals from the proximity sensors 26 and ladder and gate sensors 28 wirelessly, in order to prevent the propeller 30 from spinning when 1) people, animals or objects are in the danger zone around the boat motor 14 and propeller 30, or 2) the ladder 32 is in the down position, or 3) when the captain is not in proper position at the console 18 in order to operate the boat 14.

Additionally, in some embodiments, the sensors 26, 28 may also communicate with a visual and/or audio alarm that is preferably mounted on the captain's console or on (or adjacent to) the kill switch itself. The alarm may simply comprise a light that only shines when the ladder 32 is down or there are people or objects around the propeller 30. Similarly, the alarm may include an audio alarm (beeping, buzzing, a voice describing the warning, or the like). Separate sensors 26, 28 may have separate alarms, if desired, so that the proximity sensors 26 light up a 'propeller danger zone' light, and the ladder sensor 28 lights up the 'ladder down' warning light, for example.

Figure 5:
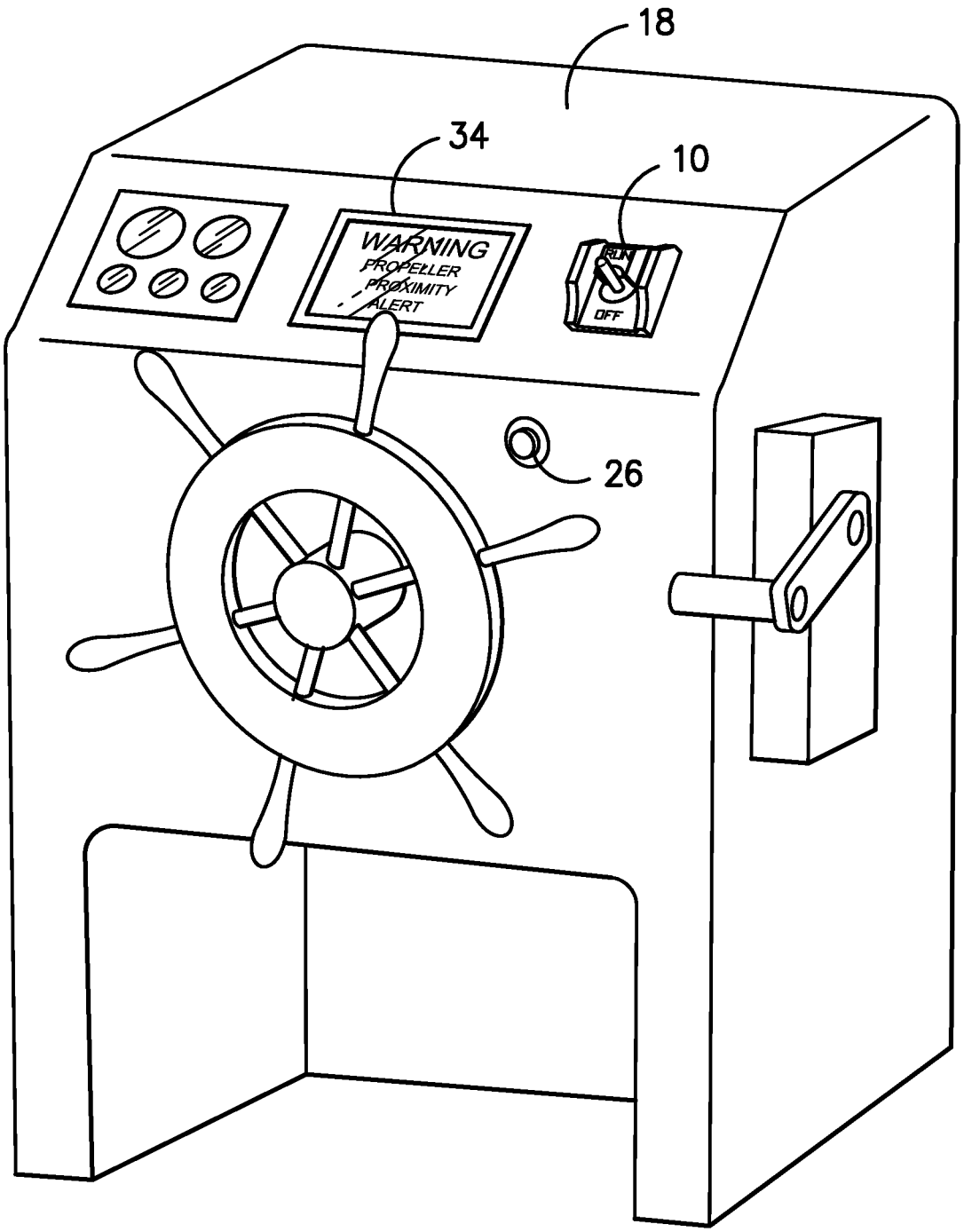
FIG. 5 is one embodiment of a captain's console on a boat, including a console proximity sensor for detecting whether a captain is in position to operate the boat, a kill switch, and a video screen that displays warnings based on input from various sensors arrayed around the boat.

Alternatively, it is contemplated that a video screen 34 may be used as the video alarm. For instance, the kill switch 10 may communicate directly with a video screen 34 or touch screen 34 on a boat that is also used for navigation, audio information and control, etc., such as a commonly used touchscreen made by Simrad, for instance. In this embodiment, any alarm that is caused by any of the sensors 26, 28 may be communicated through the kill switch 10 to the video screen 34 on the captain's console 18 (or the sensors 26, 28 may communicate directly with the video screen 34), so that the specific warning appears to the captain onscreen. For example, the video screen 34 may display any of the following: "Ladder Down," "Front Gate Open," "Rear Gate Open," "Proximity Alert—Propeller Danger," or the like, as shown in FIG. 5.

Proximity sensors 26 are ubiquitous on automobiles today, and are used to alert drivers to potential road hazards (such as a stopped vehicle ahead) and for backing into tight spaces (in a garage or parallel parking spot, for instance). These types of proximity sensors 26 may be incorporated into the present system, preferably behind the boat 14 in the propeller 30 danger zone. When the proximity sensors 26 detect an object in close proximity to the propeller 30, then the proximity sensor 26 transmits a signal to the kill switch 10, which prevents the motor from running (or alternatively, allows the motor to idle, but prevents the propeller(s) from spinning). The proximity sensors 26 are also operatively connected to the video screen 34, either directly, or through the kill switch 10. Ultrasonic sensors may be used for this purpose, as well, and may be placed below the water line in order to detect submerged objects. It should be understood that proximity sensors 26 may be mounted around the hull of the boat 14 in any desired location, if desired, to detect objects anywhere in the general vicinity of the boat, including areas that are not necessarily in close proximity to the propeller(s) 30.

Figure 3:
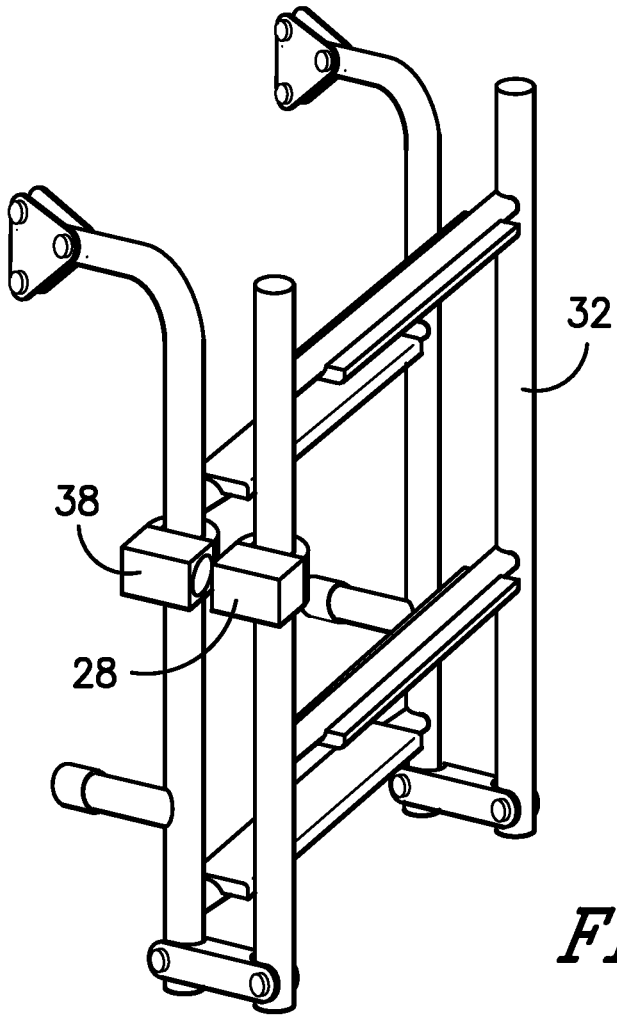
FIG. 3 is a perspective view of a collapsible boat ladder including a contact sensor that detects whether the ladder is in the collapsed position or the open/down position.
Figure 4:
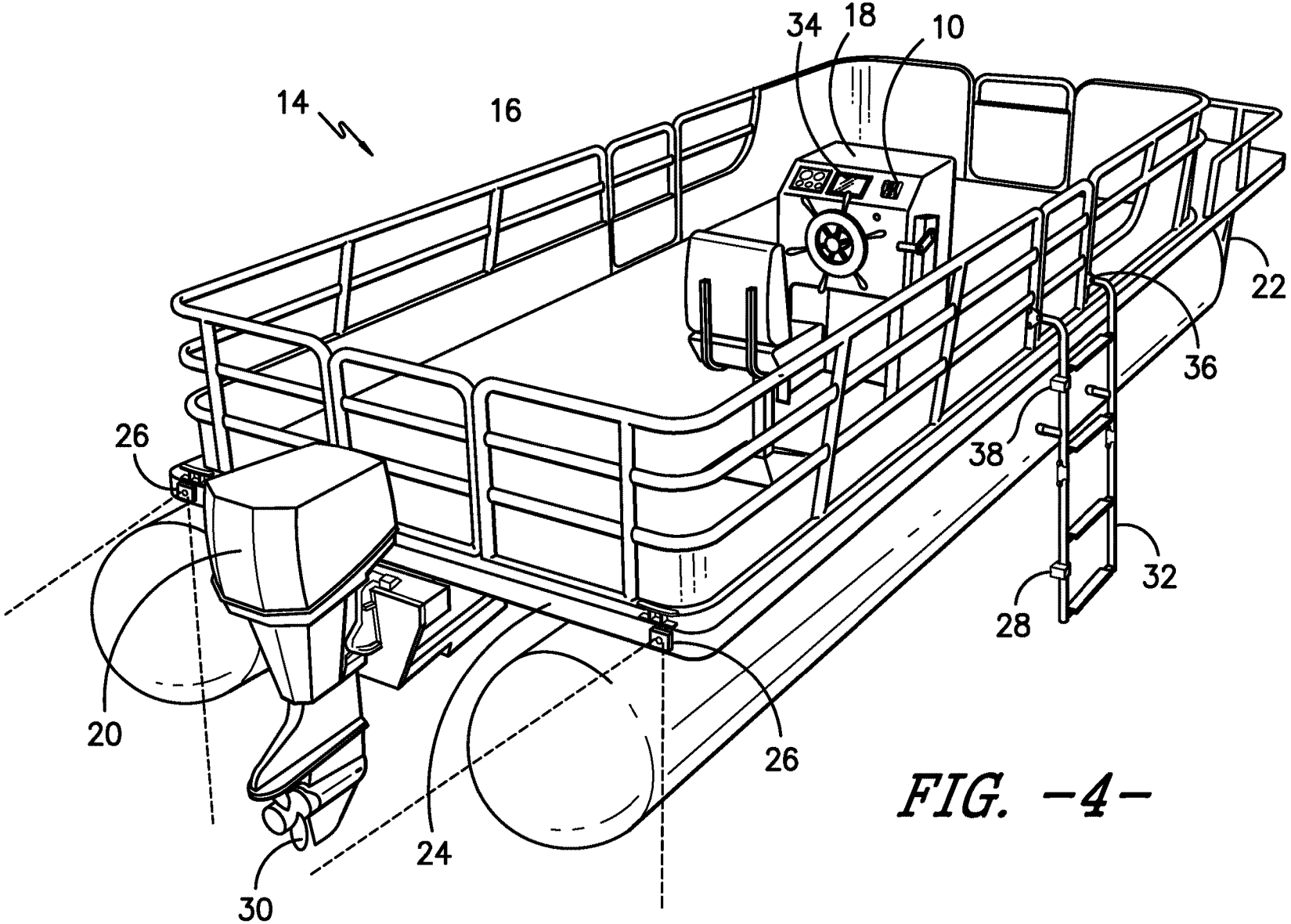
FIG. 4 is a perspective view of one embodiment of a boat having a boat safety system installed thereon, wherein the boat safety system includes a kill switch that receives input from a pair of proximity sensors on the stern for detecting swimmers or objects that are near the boat motor and propeller, a proximity sensor on the console for detecting whether a captain is in position to operate the boat, and a video screen that displays warnings based on input from the sensors.

The ladder sensor 28 may take many forms. It may be as simple as a pressure switch or contact sensor mounted on the ladder as shown in FIG. 3, so that when the ladder 32 is folded and in the storage position, the contact sensor 28 communicates with the kill switch 10, which allows the boat motor 20 to run and the propeller 30 to rotate. When the ladder 32 is in the down position, and the contact sensor 28 is inactivated, then that information is communicated to the kill switch 10, causing the kill switch 10 to prevent the motor 20 from running and/or the propeller 30 from spinning. However, other types of sensors may be used, as well, including a water sensor for detecting when the sensor is submerged. In that embodiment, the water sensor is mounted on the portion of the ladder 32 that drops down into the water, and communicates to the kill switch 10 that the ladder 32 is in the down position due to the sensor being submerged, thereby preventing the propeller 30 from spinning so long as the water sensor is submerged. It should be understood that any suitable sensor may be used to detect the ladder 32 position, and those skilled in the art will recognize that various other types of sensors may be used, including laser sensors, motion sensors, or any other type of suitable sensors.

Figure 2:
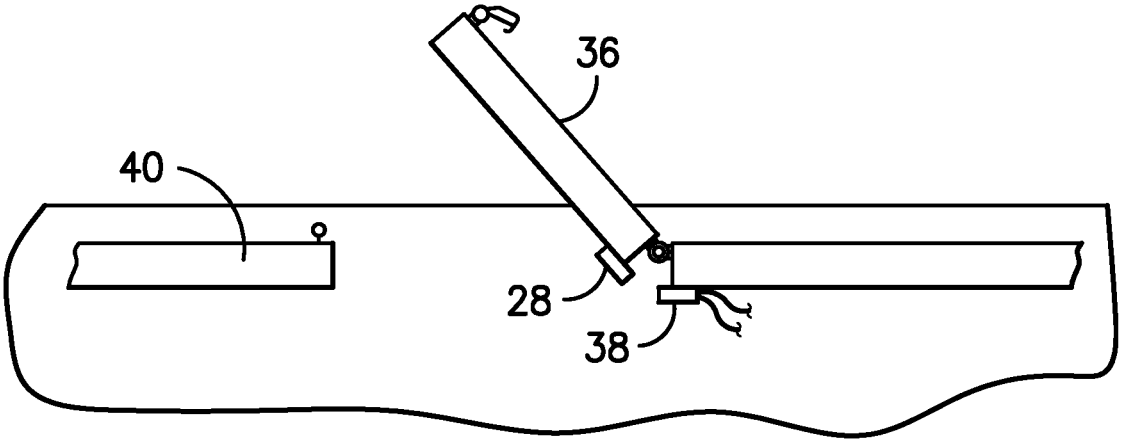
FIG. 2 is a top view of one embodiment of a gate on a boat, wherein the gate includes a contact sensor to detect whether the gate is in an open position or a closed position.

Similarly, gate sensors 28 may be employed on any or all doorways or gates 36, as shown in FIG. 2, particularly on pontoon boats and the like. Preferably, these sensors are contact sensors 28 that are in communication with the kill switch 10, so that when the gate 36 is closed, the contact sensor 28 on the gate 36 is in contact with the base 38 on the gate frame 40, the propeller 30 is allowed to spin. If the gate 36 is open, the propeller 30 does not spin.

In another embodiment, a proximity sensor 26 may be positioned on or near the captain's console 18 for detecting when the captain is positioned at or near the helm of the boat 14. This console proximity sensor 26 is also in operative communication with the kill switch 10 (either hard wired together or in wireless communication therebetween), and may be used instead of, or in conjunction with, the fob 12. The console proximity sensor 26 serves the same purpose as the lanyard, so that when the captain moves away from the console 18 (or is thrown from the boat in a man-overboard situation), the proximity sensor 26 detects that the captain is not at the helm or console 18, and is thus unable to control the boat 14, and communicates that information to the kill switch 10 in order to shut the motor 20 down, or otherwise prevent the propeller 30 from spinning while the helm is unattended.

Figure 6:
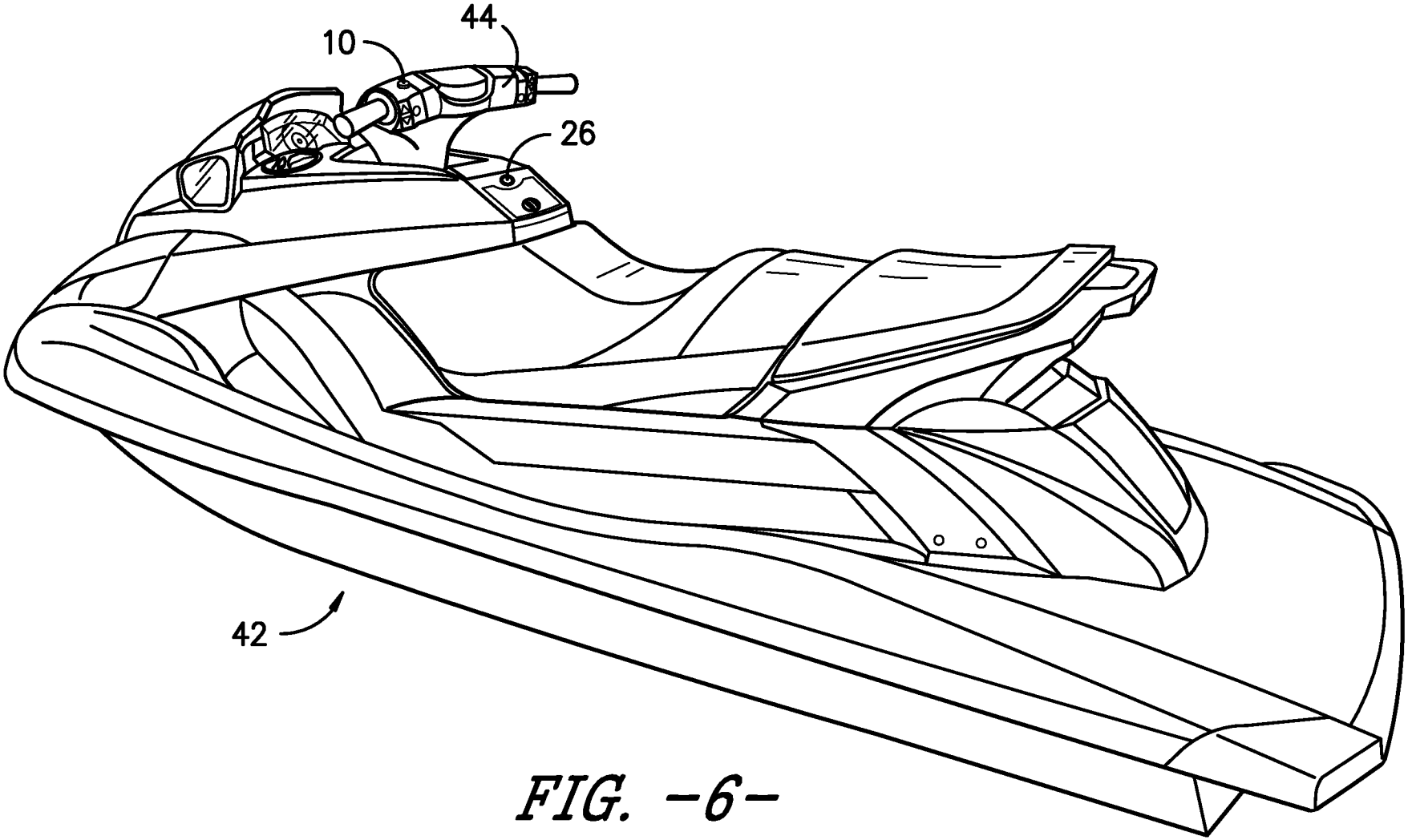
FIG. 6 is a perspective view of one embodiment of a watercraft safety system, showing a partial view of a personal watercraft having a handlebar member, wherein a proximity sensor is positioned on a central portion of the handlebar member for detecting the presence of an operator in proper position to operate the personal watercraft.
Figure 7:
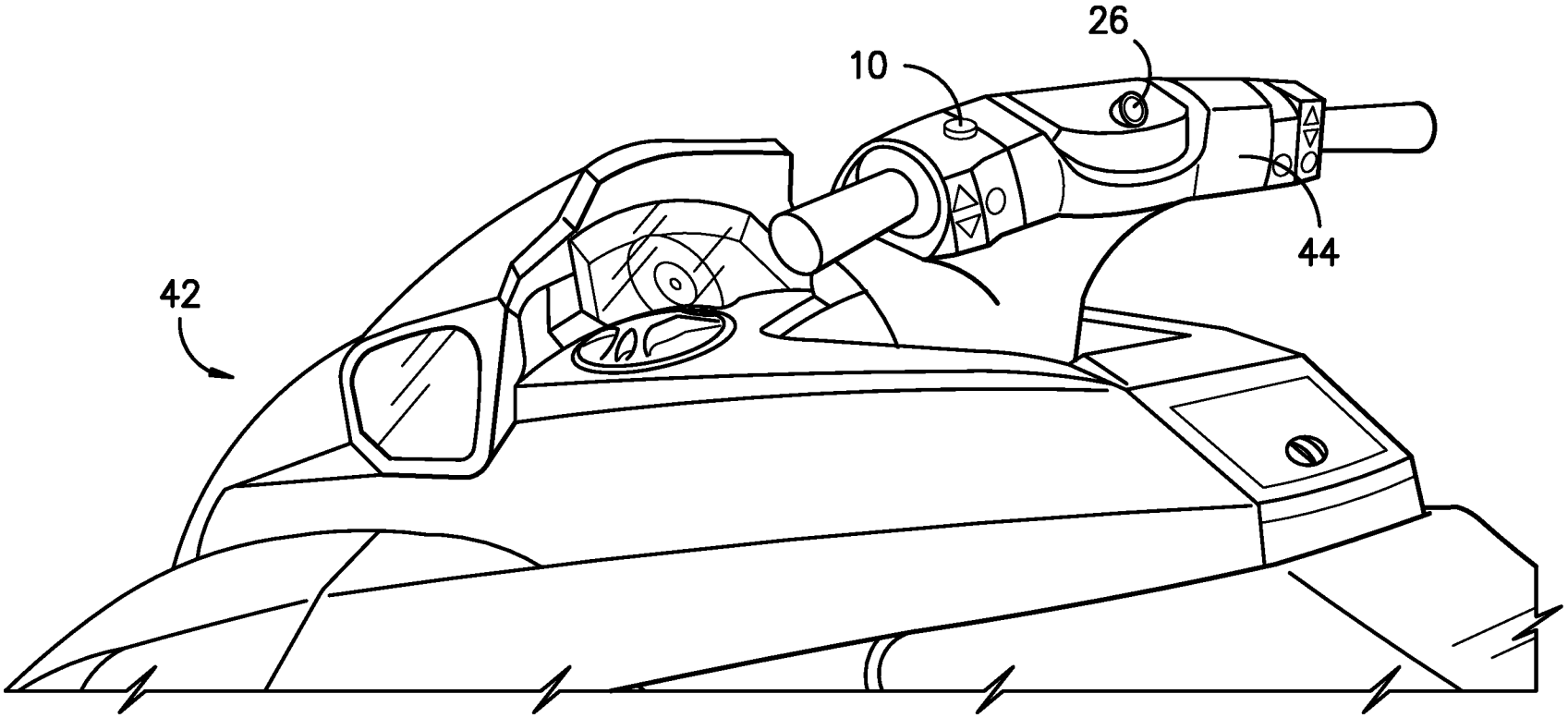
FIG. 7 is a perspective view of one embodiment of a personal watercraft having watercraft safety system, wherein a proximity sensor is mounted on a console below the handlebar member for detecting the presence of an operator in proper position to operate the personal watercraft.

This particular embodiment may also be used for other vehicles, as well, including all-terrain vehicles (ATVs), personal watercraft 42, such as jet skis and the like, instead of a lanyard, so that if the driver of the personal watercraft 42 falls off and into the water while the watercraft 42 is underway, for instance, then the motor shuts off. This arrangement serves the same purpose as the traditional lanyard/kill switch assembly, without the hassle of wearing the lanyard around the driver's wrist. As shown in FIG. 6, a personal watercraft 42 may include a proximity sensor 26 positioned on a console beneath the handlebar member 44. As in other embodiments, the console proximity sensor 26 is operatively connected to a kill switch 10, so that the personal watercraft 42 will only run if the proximity sensor 26 detects that an operator is in proper position to operate the personal watercraft 42. Similarly, FIG. 7 shows the proximity sensor 26 positioned on a central portion of the handlebar member 44. It should be understood that a such a proximity sensor may be placed in any suitable position for this purpose, so long as it is capable of detecting whether or not an operator is properly positioned on the watercraft for operation thereof.

It should be understood that the wireless communications between sensors 26, 28, the kill switch 10, and/or the alarm or video screen 34 may be of any suitable type, including radio frequency communications, WiFi, Bluetooth communications, or any other type of suitable wireless communication. Additionally, as previously mentioned, the kill switch 10 may prevent the propeller 30 from spinning while any alert from the sensors 26, 28 is currently active, so that the motor 20 remains running at idle, or it may simply prevent the motor 20 from running at all. In a preferred embodiment, the system allows additional sensors to be added thereto, so that the kill switch 10 may communicate with sensors added over time, in plug-and-play style. The sensors 26, 28 may be hardwired to the kill switch 10 and powered by the boat battery, or they may be powered by batteries and communicate with the kill switch 10 via wireless communication means.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A boat safety system comprising:

a kill switch having an on position and an off position, and further including a wireless receiver;

a fob that communicates wirelessly with said kill switch, so that said kill switch remains in said off position until such time as said fob is positioned within a predetermined proximity to said kill switch, and said kill switch remains in the on position so long as said fob is within said predetermined range of said kill switch;

a ladder sensor for detecting when a ladder is in a down position or an up position, wherein said ladder sensor is operatively connected to said kill switch so that upon detection of said ladder being in said down position, said kill switch moves to said off position; and at least one proximity sensor for determining whether an object is positioned within a predetermined range of said proximity sensor, wherein said proximity sensor is operatively connected to said kill switch so that upon detection of said object, said kill switch moves to said off position.

2. The boat safety system set forth in claim 1, wherein said proximity sensor communicates with said kill switch wirelessly.

3. The boat safety system set forth in claim 1, wherein said ladder sensor communicates with said kill switch wirelessly.

4. The boat safety system set forth in claim 1, further including an alarm device that is operatively connected to said kill switch to notify an operator that said proximity sensor has detected an object within said predetermined range thereof.

5. The boat safety system set forth in claim 4, wherein said alarm device emits an audio warning.

6. The boat safety system set forth in claim 4, wherein said alarm device displays a visual warning.

7. The boat safety system set forth in claim 4, wherein said alarm device communicates with said kill switch wirelessly.

8. The boat safety system set forth in claim 1, further including a gate sensor to determine whether a gate is in an open or closed position, said gate sensor operatively connected to said kill switch so that when said gate sensor detects that said gate is in an open position, said kill switch moves to said off position.

9. A watercraft safety system comprising:

a watercraft having a motor;

a kill switch operatively connected to said motor, said kill switch having an on position and an off position for controlling said motor, and said kill switch further including a wireless receiver;

a gate sensor to determine whether a gate is in an open or closed position, said gate sensor operatively connected to said kill switch so that when said gate sensor detects that said gate is in an open position, said kill switch moves to said off position; and a first proximity sensor for detecting when a user is in position to operate said watercraft, wherein said first proximity sensor communicates with said kill switch, so that said kill switch remains in said off position until such time as said first proximity sensor detects that said user is in proper position to operate said watercraft, and said kill switch remains in the on position so long as said first proximity sensor detects the presence of said user.

10. The watercraft safety system set forth in claim 9, further including a second proximity sensor positioned on a stern of said watercraft for determining whether an object is positioned within a predetermined range of said motor, wherein said second proximity sensor is operatively connected to said kill switch so that upon detection of said object, said kill switch moves to said off position.

11. The watercraft safety system set forth in claim 10, wherein said second proximity sensor communicates with said kill switch wirelessly.

12. The watercraft safety system set forth in claim 9, further including a ladder attached to said watercraft and a ladder sensor for detecting when said ladder is in a down position or an up position, wherein said ladder sensor is operatively connected to said kill switch so that upon detection of said ladder being in said down position, said kill switch moves to said off position.

13. The watercraft safety system set forth in claim 12, wherein said ladder sensor communicates with said kill switch wirelessly.

14. The watercraft safety system set forth in claim 10, further including an alarm device that is operatively connected to said kill switch to notify an operator that said second proximity sensor has detected an object within said predetermined range thereof.

15. The watercraft safety system set forth in claim 14, wherein said alarm device emits an audio warning.

16. The watercraft safety system set forth in claim 14, wherein said alarm device displays a visual warning.

17. The watercraft safety system set forth in claim 14, wherein said alarm device communicates with said kill switch wirelessly.

18. The watercraft safety system set forth in claim 9, wherein said gate sensor communicates with said kill switch wirelessly.

* * * * *